US006545693B2

(12) United States Patent
Kitayama et al.

(10) Patent No.: US 6,545,693 B2
(45) Date of Patent: Apr. 8, 2003

(54) EXPOSING UNIT HAVING FIRST AND SECOND FIXING MEMBERS

(75) Inventors: Kunihiko Kitayama, Ibaraki (JP); Akio Ohno, Kanagawa (JP); Kiyoharu Tanaka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/887,050

(22) Filed: Jun. 25, 2001

(65) Prior Publication Data

US 2002/0021347 A1 Feb. 21, 2002

(30) Foreign Application Priority Data

Jun. 30, 2000 (JP) ..... 2000-197564

(51) Int. Cl.[7] ..... B41J 2/385; G03G 13/04; G03G 15/00

(52) U.S. Cl. ..... 347/138; 347/152; 347/263; 399/126; 399/177

(58) Field of Search ..... 347/138, 152, 347/257, 263; 399/118, 126, 177

(56) References Cited

U.S. PATENT DOCUMENTS 4,511,237 A * 4/1985 Kawata et al. ..... 399/118
5,235,348 A * 8/1993 Avonts
6,118,463 A * 9/2000 Houki et al.
6,252,619 B1 * 6/2001 Ueda et al. ..... 347/138

FOREIGN PATENT DOCUMENTS

EP 464269 A1 * 1/1992
JP 10-39587 * 2/1998

* cited by examiner

*Primary Examiner*—Susan S. Y. Lee
(74) *Attorney, Agent, or Firm*—Fitzpatrick, Cella, Harper & Scinto

(57) ABSTRACT

To provide an exposing apparatus including a first fixing member which positions and fixes a vicinity of an exposing unit on a side of a photosensitive body, and a second fixing member which fixes a vicinity of an end of the exposing unit on a side opposite to a location fixed by the first fixing member for preventing the exposing unit from being inclined when positioning and fixing the exposing unit.

7 Claims, 15 Drawing Sheets

EXPOSING UNIT HAVING FIRST AND SECOND FIXING MEMBERS

BACKGROUND OF THE INVENTION

1. Field of the Invention

The present invention relates to an exposing apparatus.

2. Related Background Art

Referring to the accompanying drawings, description will be made of a method for positioning an exposing unit 12' relative to a photosensitive body in a conventional exposing apparatus.

FIG. 10 is a perspective view descriptive of a photosensitive drum 11' and an exposing unit 12'. FIG. 11 is a diagram descriptive of a side surface.

Base members 23' and 24' are fixed to a front side plate 21' and a rear side plate 22' of a main body, respectively. Focusing pins 31' and 32' which serve as members for supporting the exposing unit 12' are mounted on the base members 23' and 24' respectively so as to be movable in a depth direction (y direction).

Engaging portions of the base members 23', 24' and the focusing pins 31', 32' are threaded, whereby heights of the focusing pins 31' and 32' from the base members 23' and 24' are changed when the focusing pins 31' and 32' are turned. The exposing unit 12' is mounted on two front and rear pedestals 31*a*' and 32*a*' of the focusing pins. When the focusing pins 31' and 32' are rotationally adjusted as described above, the pedestals 31*a*' and 32*a*' of the focusing pins are displaced in a height direction, whereby a position of the exposing unit 12' is adjusted in the depth direction.

For locking and rattling prevention, a bonding agent is preliminarily coated over entire circumferences of the threaded portions of the focusing pins 31' and 32' which are engaged with the base members 23' and 24'. Furthermore, tips of the focusing pins 31' and 32' are slotted so that these pins can be rotationally adjusted with a screwdriver.

Two positioning run-through holes are formed at both ends of the exposing unit 12'. On the other hand, shaft forms are disposed on the pedestals of the focusing pins 31' and 32'. A round hole 121' and an elongated round hole 122' which are run-through holes are fitted over shaft root portions 31*b*' and 32*b*' of the focusing pins respectively. Accordingly, the exposing unit 12' is positioned on a plane coordinate system (x-z coordinate system). Then, the exposing unit 12' is fixed to the pedestals 31'*a* and 32'*a* of the focusing pins by urging the exposing unit using elastic fixing means (not shown) in a direction indicated by an arrow A in FIG. 11. Positioning and fixing of the exposing unit 12' are thus completed.

Description will be made here of why the exposing unit 12' is elastically fixed. An optical inconvenience such as curving of a scanning line may be produced when the exposing unit is deformed. When the exposing unit is fixed firmly with screws, the exposing unit may be deformed due to screw tightening torques during fixing or due to thermal expansion when a temperature rises in the exposing apparatus. When the exposing unit 12' is mounted on the main body only by a weight of the exposing unit without being fixed, on the other hand, the exposing unit may be broken during transit or an image may be ununiform due to vibrations at an image forming time, whereby, the exposing unit 12' is practically unusable. The exposing unit 12' is therefore elastically fixed to the main body of the exposing apparatus to prevent the above described problems.

However, the above described conventional positioning method poses a problem that the method allows a depth of the exposing unit to be deviated as described below.

Fitting plays are reserved in a radial direction between the run-through holes 121', 122' and the shaft root portions 31*b*' and 32*b*' which are fitting parts. This is because the exposing unit cannot be mounted as a matter of course when no gap remains. Furthermore, the fitting plays serve not to restrict span changes on sides of the main unit and the exposing unit due to thermal expansion caused by the above described temperature rise in the exposing apparatus, thereby preventing a stress from being produced in the exposing unit.

Furthermore, axial lines of the front and rear focusing pins 31' and 32' are usually not in parallel with each other, but inclined due to tolerances of parts such as a main body frame. Fitting lengths are therefore set rather short so that the exposing unit 12' can be mounted.

No optical problem is posed even when the exposing unit is statically deviated in the x direction and the z direction within the range of the fitting play. However, inclination of the exposing unit poses a problem of a deviation (inaccuracy) of a depth. A cause for the depth deviation is classified into (1) tilting of the exposing unit and (2) poor reproducibility of a positional relation between a jig and the exposing unit.

First, description will be made of "depth deviation due to tilting of the exposing unit". When an external force is exerted to the exposing unit, the exposing unit is inclined, thereby changing an optical path length. A concrete example of exerted external force is a stress produced by an electric line bundle (between the exposing unit and the main body) or the like.

Referring to FIGS. 12A, 12B, 13A and 13B, description will be made of the tilting of the exposing unit and the change of the optical path length. FIG. 12A is a sectional view of the focusing pin 31' of the exposing unit 12' and FIG. 12B is an optical diagram in a regular condition corresponding to FIG. 12A. Furthermore, FIG. 13A is a diagram showing a condition where the exposing unit is inclined and FIG. 13B is an optical diagram in an inclined condition corresponding to FIG. 13A.

Rays emitted from light emitting means 201' in the exposing unit 12' are imaged by a lens array 202' used as imaging means onto a surface of the photosensitive drum 11' which is an electrophotographic photosensitive body. A regular optical path length L1 shown in FIG. 12B is 10 mm.

On the other hand, a diameter d of the run-through holes 121', 122' and the shaft root portions 31*b*', 32*b*' has a nominal value of 4 mm, and the fitting plays have a diameter of 20 $\mu$m. A fitting length b is set at 1.6 mm. Furthermore, the pedestal 31*a*' has a radius R1 of 4.5 mm. When the exposing unit 12' is inclined relative to the focusing pins, an inclination angle $\Theta 1$ is 0.7 degrees at maximum.

In FIGS. 13A and 13B, an external force is exerted in a direction indicated by an arrow B. The exposing unit 12' is inclined around a point C in contact with the pedestal 31*a*' of the focusing pin which functions as a rotating fulcrum. In the inclined condition, an optical path length L2 is 10.06 mm. That is, a depth deviation of 60 $\mu$m is produced.

This depth deviation is geometrically reduced by shortening a radius R1 of the pedestal 31*a*'. However, the radius cannot be shortened easily since the shortening of the radius produces a defect to make a mounted condition of the exposing unit dynamically unstable, whereby an image may be uneven (ununiform) due to the vibrations.

Then, description will be made of "depth deviation due to poor reproducibility of the positional relation between the jig and the exposing unit". FIG. 14 is a diagram descriptive of a mounted condition of jig units 99' relative to the focusing pins 31' and 32', and FIG. 15 is a diagram descriptive of a mounted condition of the exposing unit 12' relative to the focusing pins 31' and 32'. A section of a front side of the exposing unit 12' is shown on a left side and a section on a depth side is shown on a right side in FIG. 14.

Heights of the focusing pins 31' and 32' are usually adjusted with the Jig units 99' having dial gauges or the like mounted on portions to be adjusted (focusing pins) in the main body. After the adjustment, the jig units 99' are dismounted and the exposing unit is assembled.

On the other hand, the axial lines of the front and rear focusing pins 31' and 32' are not in parallel with each other under influences of the allowances of the parts as described above. Surfaces of the pedestals of the focusing pins 31' and 32' have an inclination angle which is indicated by Θ2 in FIG. 14. Since the pedestals on which the exposing unit is to be mounted do not form a planar surface and the fitted portions have a degree of freedom, a posture (angle) of the exposing unit is not defined clearly but optional. Description will be made below of a mechanism to produce the depth deviation when a mounted condition (the posture of the exposing unit) is changed between adjusting time with the jig units and an exposing unit assembling time. The inclination angle Θ2 is assumed as 0.5 degree.

The jig units 99' are assumed to be along the surface of the pedestal 31*a'* of the front side focusing pin 31' at the adjusting time with the jig units as shown in FIG. 14. At this time, a depth side is supported at a point. The jig unit 99' is brought in contact with a portion D which is a corner of the surface 32*a'* of the focusing pin 32'. The heights are adjusted with the exposing unit kept in this posture. Both front and rear imaginary optical path lengths Lf1 and Lr1 are 10 mm.

In contrast, let us consider a case where mounted conditions of the jig units are not reproduced due to the posture of the exposing unit. The exposing unit 12' is assumed to be along the surface of the pedestal 32*a'* of the depth side focusing pin 32' as shown in FIG. 15. The front side is in contact with a portion E which is a corner of the surface of the pedestal 31*a'* of the focusing pin 31'. The exposing unit 12' shown in FIG. 15 is rotated clockwise relative to the jig units 99' shown in FIG. 14. As the exposing unit is rotated, the front side floats up using the portion E as a fulcrum, whereas the depth side sinks using the portion D as a fulcrum. Accordingly, the optical path length is changed. The front and rear optical path lengths Lf2 and Lr2 have deviation distances of +40 μm and −40 μm respectively from the regular optical path length.

As causes for degrading a reproducibility of the mounted conditions, there can be mentioned (1) an external force exerted (example: a stress applied to the units from an electric line bundle), (2) slight differences in forms, masses and centers of gravity of the jig units from those of product units, and (3) randomness (contingency) due to stabilities of the mounted conditions which are at a similar degree.

The depth deviation on the order of 60 μm at maximum can be produced due to "tilting of the exposing unit" and "poor reproducibility of the positional relation between the jig units and the exposing unit" as described above.

Then, description will be made of a standard (tolerance) for the depth. The depth is generally on the order of ±70 μm though the depth is dependent on a design of an optical system. This value is classified dependently on tolerances as described below.

(1) Tolerance for adjustment in the exposing unit: ±20 μm (2) Tolerance for adjustment in the main unit (between a drum support portion and a exposing unit attaching portion): ±20 μm (3) Precision for parts of the photosensitive drum (swing of the photosensitive drum): ±20 μm (4) Margin: ±10 μm Items (1) through (3) mentioned above are critical for steps of mass production, thereby resulting in only a little margin.

The above described depth deviation distance (60 μm) is far larger than the margin (10 μm), thereby making a depth out of the standard. As a result, the depth deviation distance produces a defective image which is defocused.

As compared with a laser scanning system, an LED exposing system which forms a latent image on an image bearing body by imaging rays emitted from light emitting means composed of a plurality of light emitting diodes (LEDs) on the image bearing body by imaging means in particular has a merit to configure an apparatus remarkably compact. The LED exposing system exhibits a remarkable effect in particular for a color image forming apparatus which comprises a plurality of image forming portions. A slight inclination of the exposing unit therefore produces a large influence on an image quality.

Accordingly, an LED array which is the light emitting means and a SELFOC lens array which is the imaging means are usually configured as a unit in the LED exposing system, but for controlling an optical path length within a predetermined range, it is necessary to adjust a position of an LED head used as the exposing unit (exposing means) relative to the photosensitive body with a precision on the order of some tens of microns in the depth direction.

SUMMARY OF THE INVENTION

An object of the present invention is to provide an exposing apparatus which prevents an exposing unit from being inclined, thereby preventing images from being defocused.

Another object of the present invention is to provide an exposing apparatus which allows an exposing unit to be mounted easily and with a high precision.

Still another object of the present invention is to provide an exposing apparatus which comprises an exposing unit for exposing a photosensitive body, a first fixing member for positioning and fixing a vicinity of an end of the exposing unit on a side of the above described photosensitive body, and a second fixing member for fixing a vicinity of an end on a side opposite to a fixing position fixed by the first fixing member.

Further objects of the present invention will be apparent from the following description.

DETAILED DESCRIPTION OF THE PREFERRED EMBODIMENTS

Now, embodiments of an electrophotographic image forming apparatus according to the present invention will be described with reference to the accompanying drawing.

First Embodiment

First, description will be made of a first embodiment.

(Overall Configuration of Image Forming Apparatus)

Figure 4:
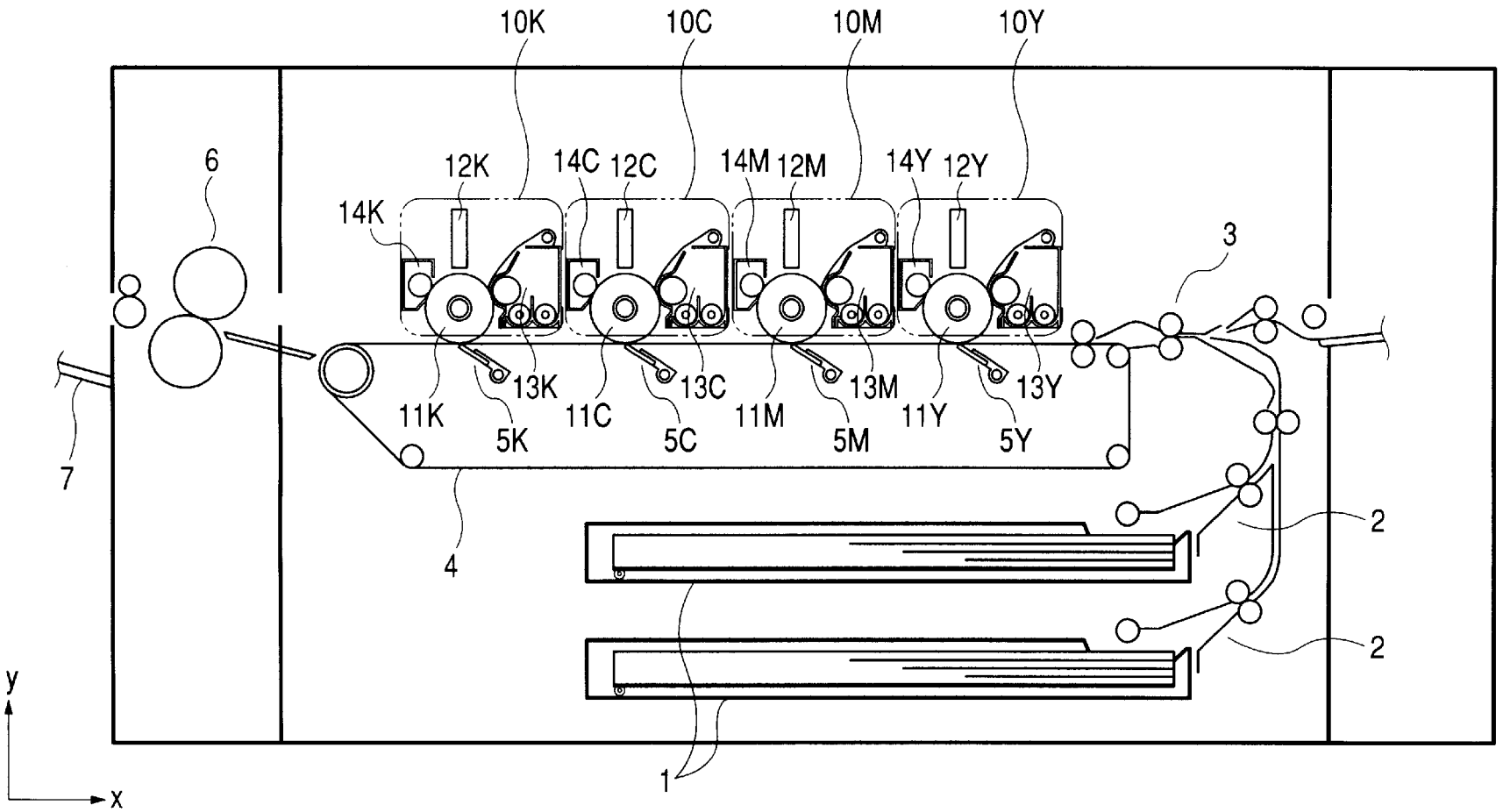
FIG. 4 is a diagram descriptive of a configuration of a copier as an example of an electrophotographic image forming apparatus according to the present invention.

FIG. 4 is a diagram descriptive of a copier as an example of the electrophotographic image forming apparatus according to the present invention. This apparatus is a color electrophotographic copier which forms an image by overlapping toners in four colors of yellow, magenta, cyan and black.

Reference characters 10Y, 10M, 10C and 10K denote yellow, magenta, cyan and black image forming portions, respectively.

A recording sheet contained in a cassette 1 is fed by a feeding member 2 and reaches a registration roller 3. After skew feeding is corrected by the registration roller 3, the recording sheet is sent out toward a transferring belt 4 at a controlled timing. While the recording sheet is sent, latent images corresponding to the colors are formed on photosensitive drums 11 (11C, 11M, 11Y and 11K) used as an electrophotographic photosensitive bodies with an image information signal sent from an original reading apparatus (not shown) or an output apparatus (not shown) such as a computer. The recording sheet which is sent from the registration roller 3 is electrostatically adsorbed to the transferring belt 4 and conveyed by the above described transferring belt 4 while passing under the image forming portions 10 for the colors (10Y, 10M, 10C and 10K).

In each image forming portion, an injection charger 14 (14Y, 14M, 14C or 14K), an LED head 12 (12Y, 12M, 12C or 12K) which is exposing means and a developing device 13 (13Y, 13M, 13C or 13K) are arranged around the photosensitive drum 11. A surface of the photosensitive drum 11 is first uniformly charged with the injection charger 14 and exposed by the LED head 12 for forming a latent image, whereafter the latent image is developed by the developing device 13 into a toner image in each color.

The image in the colors are transferred consecutively to the recording sheet by functions of transferring means 5 (5Y, 5M, 5C and 5K) at locations at which the transferring belt 4 is brought close to the photosensitive drum 11.

After the images in the four colors have been transferred, the recording sheet is separated from the transferring belt 4 by self stripping and conveyed to a fixing portion 6. The fixing portion 6 is heated and a toner in each color is thermally melted and fixed on the recording sheet. A completed color image is discharged onto a discharge tray 7 to terminate a copying operation.

(Positioning LED Head)

Figure 1:
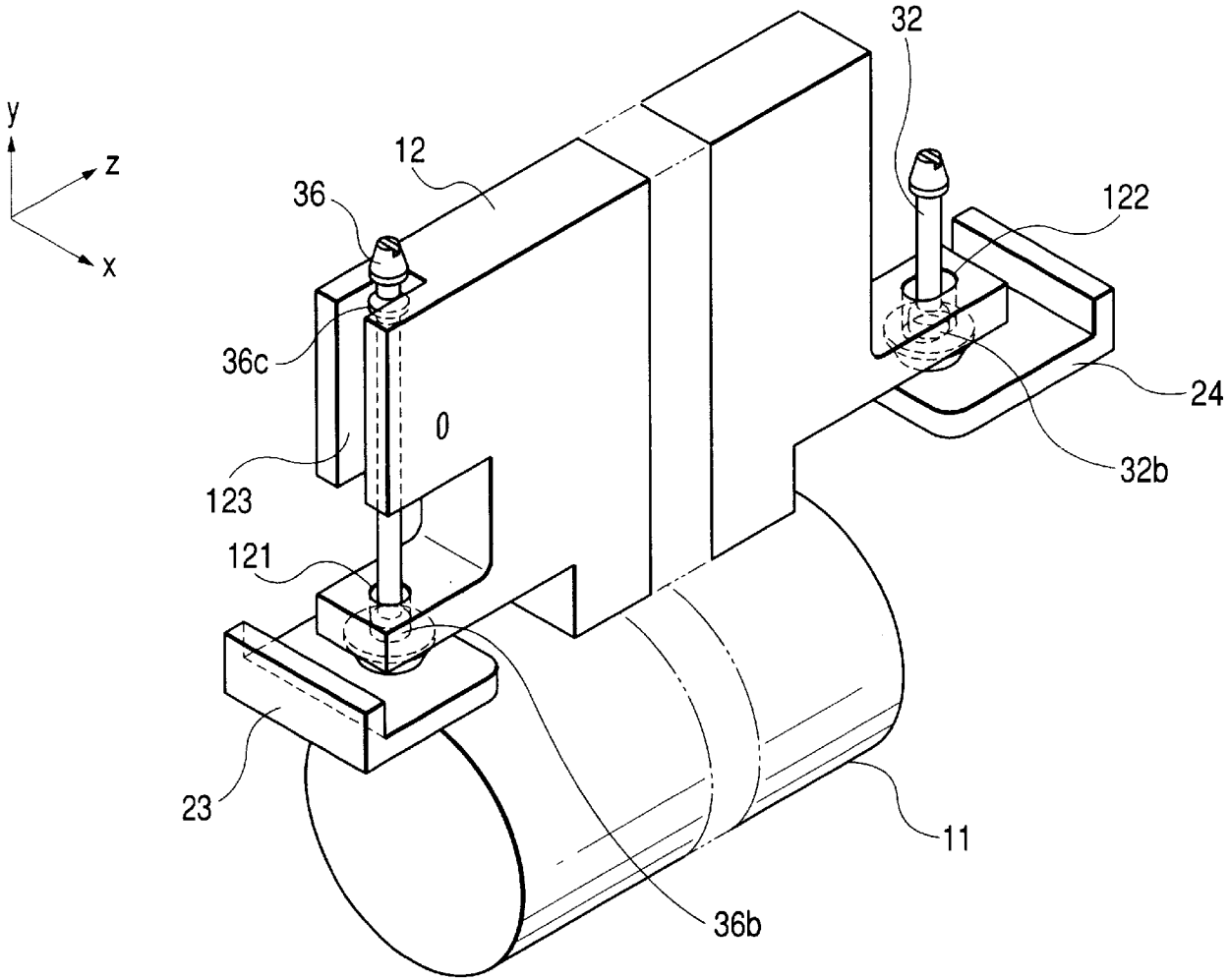
FIG. 1 is a perspective view descriptive of an LED head as a whole in a first embodiment.
Figure 2:
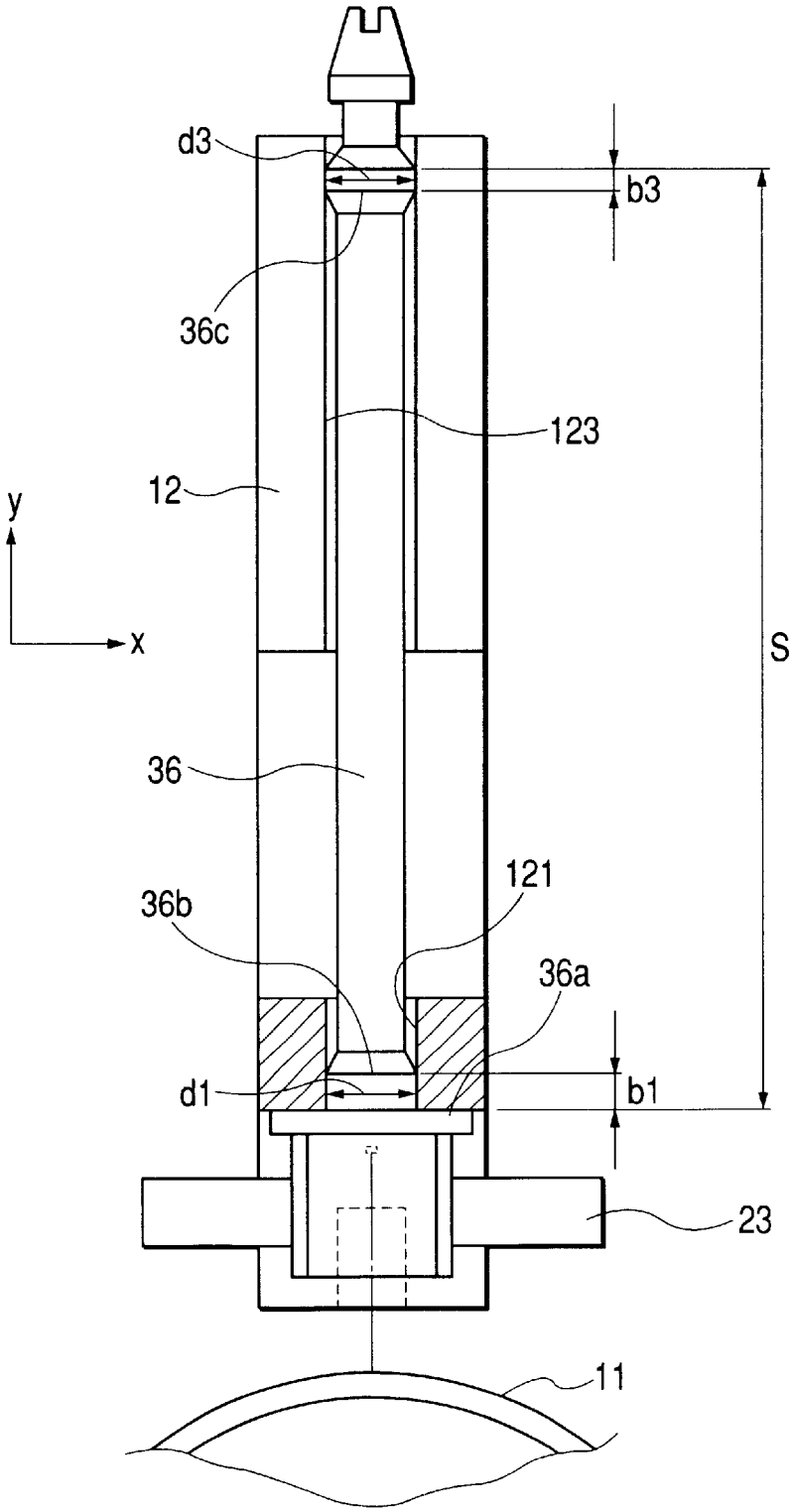
FIG. 2 is a front view descriptive of a location of a front side of the LED head shown in FIG. 1.
Figure 3:
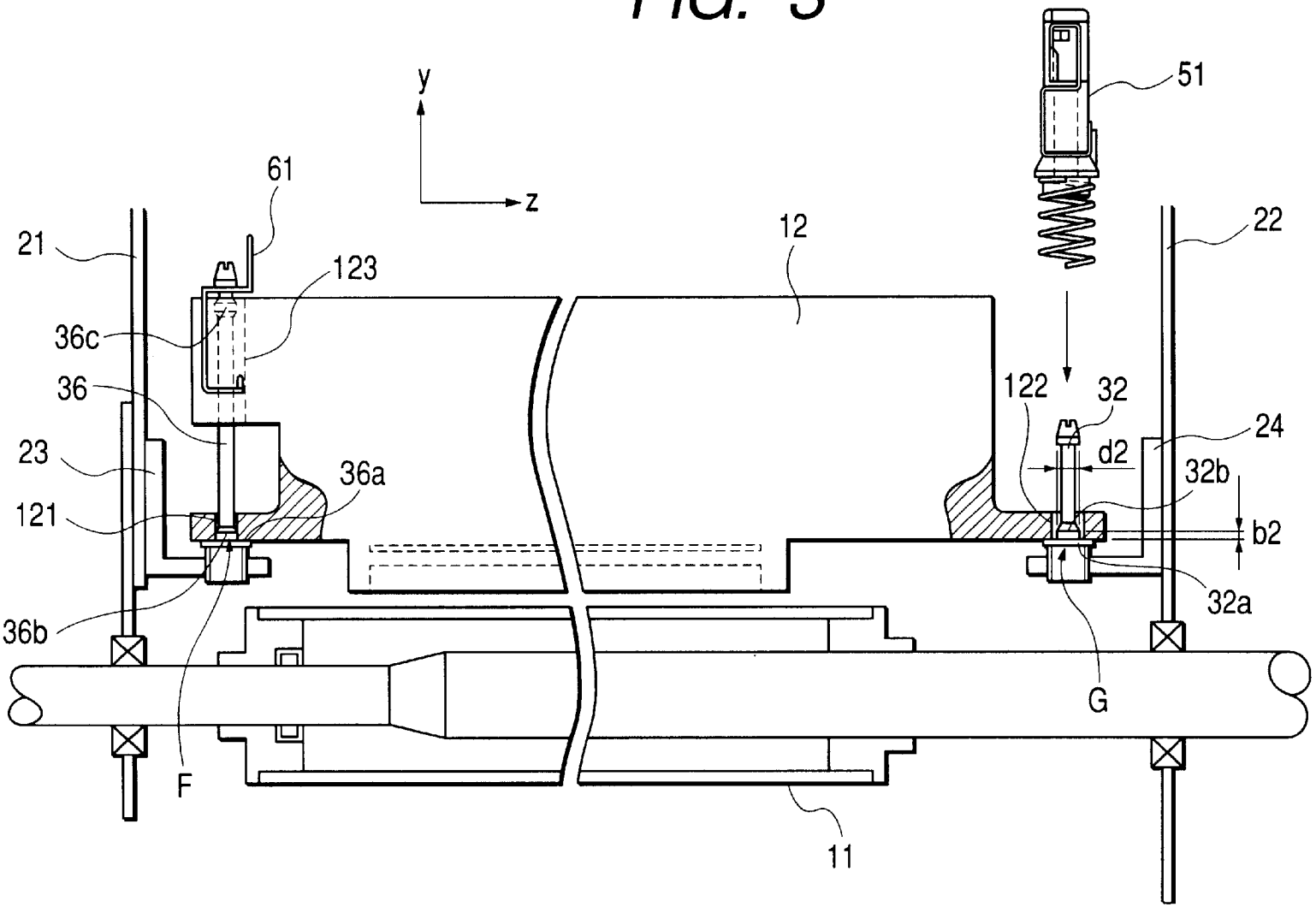
FIG. 3 is a side view descriptive of a photosensitive drum and the LED head shown in FIG. 1.

Now, referring to FIGS. 1 to 3, description will successively be made of a method for positioning the LED head 12 as exposing means relative to the main body of the exposing apparatus. FIG. 1 is a perspective view descriptive of the LED head 12 as a whole and FIG. 2 is a front view descriptive of a location of a front side of the LED head 12. Furthermore, FIG. 3 is a side view descriptive of the photosensitive drum 11 and the LED head 12.

At both ends of the LED head 12, fitting portions are formed at three locations in total for positioning the LED head. Disposed in the front side of the LED head 12 are a round slot 121 formed as a run-through hole at a lower location and a groove 123 at an upper location, which are fitted around a fitting portion 36*b* at a lower location and a fitting portion 36*c* at an upper portion respectively of the focusing pin 36. On a rear side, a root portion 32*b* of a focusing pin 32 is fitted in an elongated round hole 122 which is formed as a run-through hole.

For positioning the LED head 12 in a height direction, on the other hand, there is adopted a method similar to that in the conventional example, which adjusts heights of focusing pins 36 and 32 relative to the base members 23 and 24, and mounts the LED head 12 on two front and rear pedestals 36*a* and 32*a*.

A geometrical description will be made of how the LED head 12 is positioned in the configuration of the first embodiment. In an x direction first, there are three fitting portions of the round hole 121, the groove 123 and the elongated round hole 122, whereby a plane (y-z plane) is defined by these three points.

In a y direction, in the next place, standard planes for the both ends of the LED head 12 are positioned by mounting the LED head on the pedestals 36*a* and 32*a*. In a z direction, the LED head 12 is positioned at a location by the round hole 121. An intersection point between the round hole 121 and a front side standard plane for the LED unit is denoted by point F, and a point at which a rear side standard plane is in contact with the pedestal 32*a* is denoted by point G as shown in FIG. 3. Taking the intersection point F as a pivot point and the contact point G as a level point, a location (location of a representative point) of the LED unit and a direction (angle) of the LED unit are defined on the above described y-z plane.

A location of the LED unit including a direction (angle) of the LED unit is strictly defined as described above. In addition, the LED head 12 is fixed by urging the LED unit toward the pedestals of the focusing pins 36 and 32 as in the conventional example. In FIG. 3, reference numerals 51 and 61 denote fixing means using springs. The LED head 12 has been positioned and fixed as described above.

(Dimensions and Depth Deviation)

Then, description will be made of a dimensional relation and a depth deviation. Nominal dimensions of the fitting portions will be described. A shaft diameter d1 of the lower fitting portion 36*b* of the focusing pin 36 is Φ4 as shown in FIG. 2. A shaft diameter d3 of the upper fitting portion 36*c* is set at Φ3.8 which is a little smaller than Φ4. On the other hand, a shaft diameter d2 of the fitting portion 32*b* of the focusing pin 32 is Φ4 as shown in FIG. 3. Fitting lengths b1, b2 and b3 are on the order of 1 to 2 mm. A span S between the lower fitting portion 36*b* and the upper fitting portion 36*c* is set at 40 mm. Fitting plays of these fitting portions are assumed to have a diameter of 20 μm as in the conventional example.

When the LED unit is inclined (when the LED unit is rotated around the z axis), an inclination is regulated at two locations of the upper fitting portion 36*c* and the lower fitting portion 36*b*. Since the large span S of 40 mm is reserved, a rotating angle around the z axis is 0.03 degree at maximum which is remarkably smaller than 0.7 degree in the conventional example. A depth deviation is 2 μm at maximum.

On the other hand, the problems of the reproducibility of the positional relation between the jig and the LED unit is solved as described below.

In the configuration of the first embodiment, a relative angle allowable between the front side focusing pin 36 and the LED unit 12 is ±0.03 degree as described above. On the other hand, a relative angle allowable between the depth side focusing pin 32 and the LED unit 12 is ±0.7 degree. Values of these angles are clearly distinguished and the front side which has a smaller allowable value functions as a positioning member for regulating an inclination of the unit in an angle direction.

Unlike the conventional example, the first embodiment which has the positioning portion for clear positioning in the angle direction always positions the LED unit with the front side focusing pin 36 not using the jig unit or the product unit. Accordingly, the first embodiment prevents the depth deviation from being caused due to a change of a posture of the LED unit.

Accordingly, a depth deviation produced in the configuration of the first embodiment has an extremely small value of 2 μm at maximum which is within the above described margin (10 μm). As a result, the first embodiment provides an effect to prevent an image from being defective or defocused, thereby realizing an excellent image quality.

Second Embodiment

Figure 5:
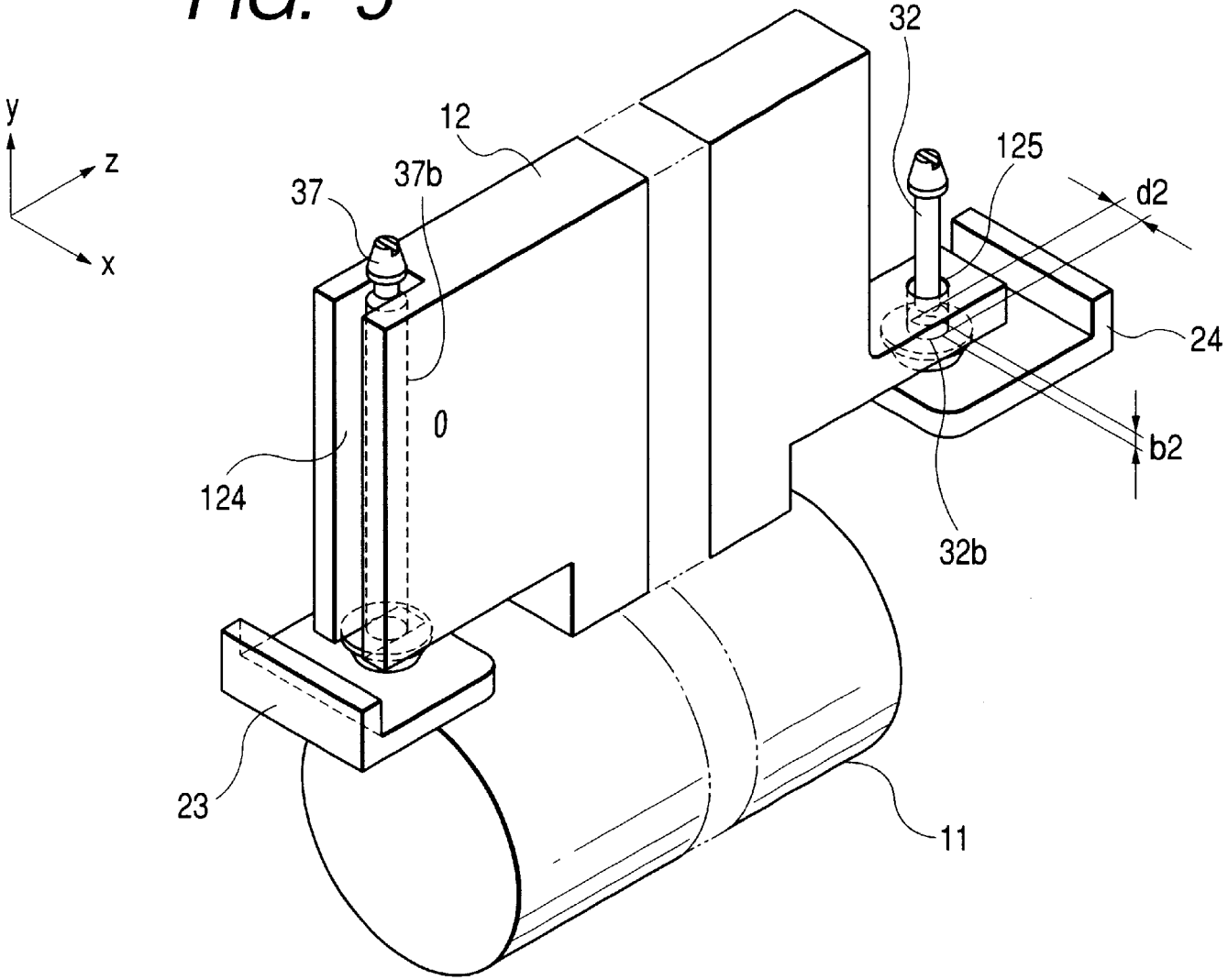
FIG. 5 is a perspective view descriptive of an LED head as a whole in a second embodiment.
Figure 6:
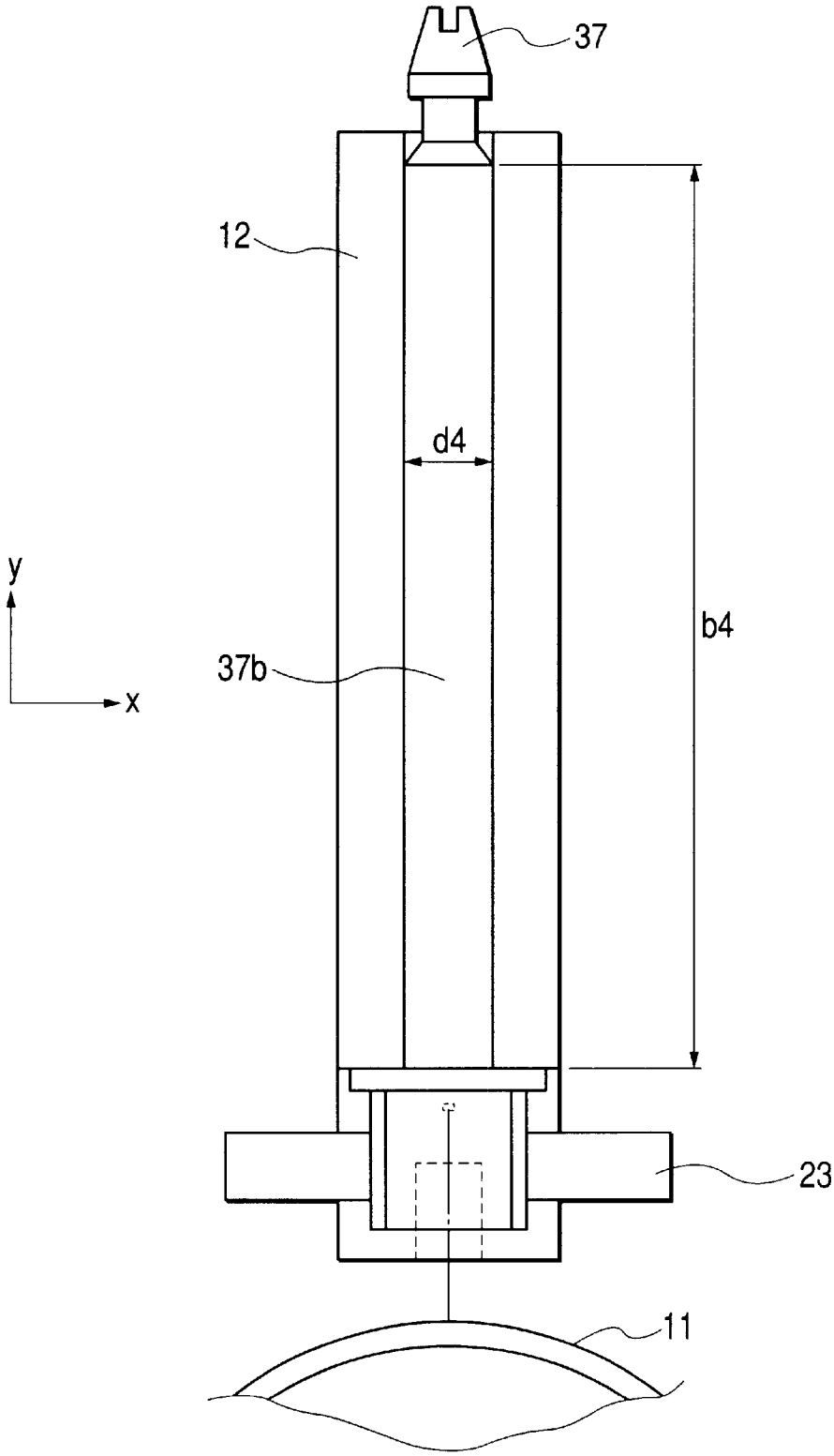
FIG. 6 is a front view descriptive of a location of a front side of the LED head shown in FIG. 5.

Then, a second embodiment which has another configuration for positioning exposing means will be described with reference to FIGS. 5 and 6. FIG. 5 is a perspective view descriptive of an LED head 12 as a whole and FIG. 6 is a front view descriptive of a front side location of the LED head 12. Furthermore, members which are the same as those of the first embodiment are denoted by the same reference numerals.

In the second embodiment, a total of two fitting portions are formed at both ends of the LED head 12. Formed in a front side of the LED head 12 is a groove 124 in which a shaft portion 37*b* of a focusing pin 37 is fitted. On a rear side, a root portion 32*b* of a focusing pin 32 is fitted in a round hole 125 which is a run-through hole. A shaft diameters d4 and d2 are 4 mm.

A fitting length b4 for the shaft portion 37*b* of the focusing pin 37 and the groove 124 is 40 mm. On the other hand, a fitting length b2 for the shaft root portion 32*b* of the focusing pin 32 and the round hole 125 is on the order of 1 to 2 mm.

In the second embodiment, a plane (y-z plane) is defined by an axial line (axial line of the shaft portion 37*b*) and a point (the shaft root portion 32*b*).

By reserving a sufficiently long fitting length on one side as described above, the LED unit is positioned in the angle direction around the z axis. As a result, the configuration of the second embodiment provides a function and an effect which are similar to the contents described in the first embodiment.

Third Embodiment

Figure 7:
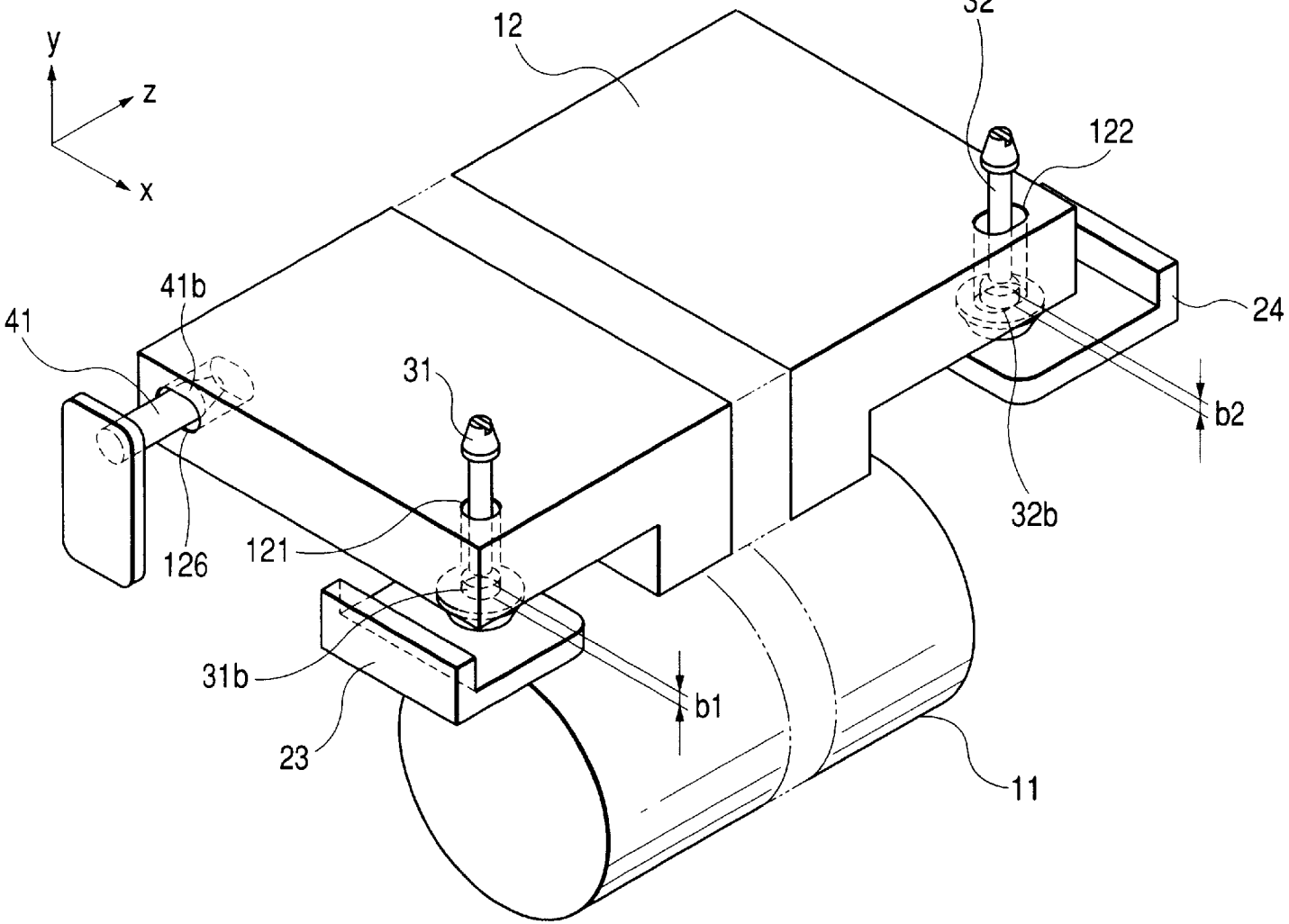
FIG. 7 is a perspective view descriptive of an LED head as a whole in a third embodiment.
Figure 8:
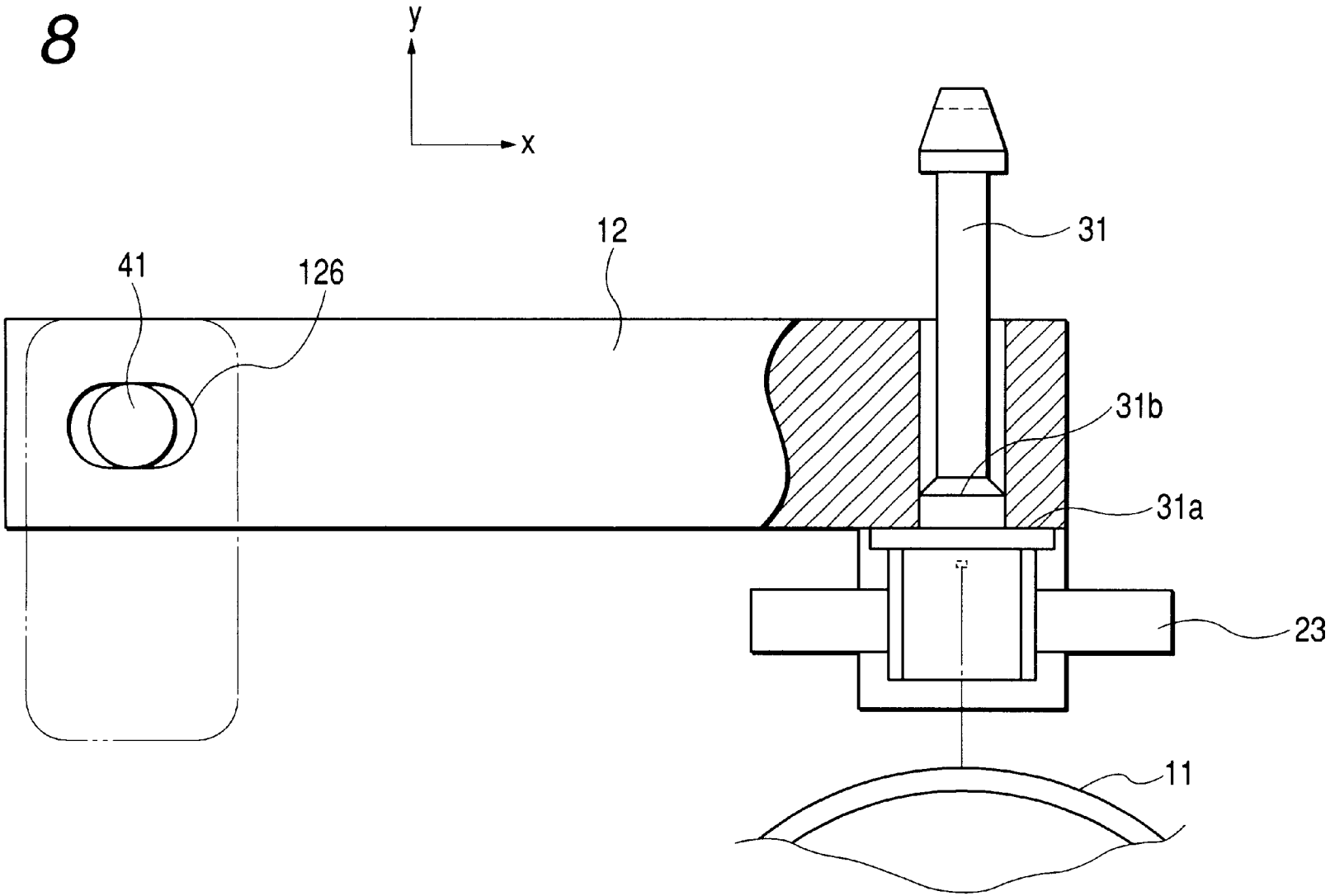
FIG. 8 is a front view descriptive of positioning of the LED head shown in FIG. 7.
Figure 9:
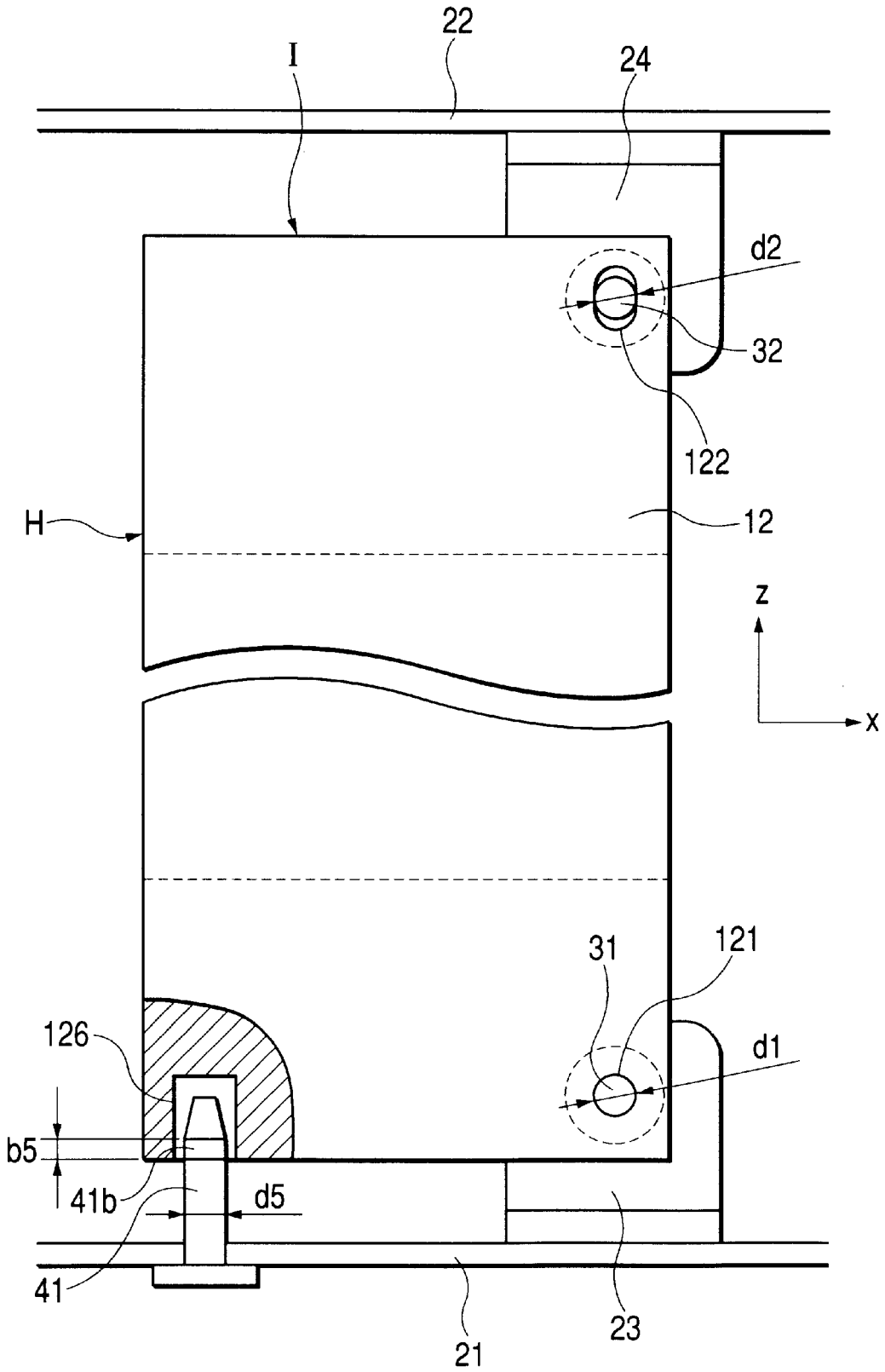
FIG. 9 is a plan view descriptive of the positioning of the LED head shown in FIG. 7.
Figure 10:
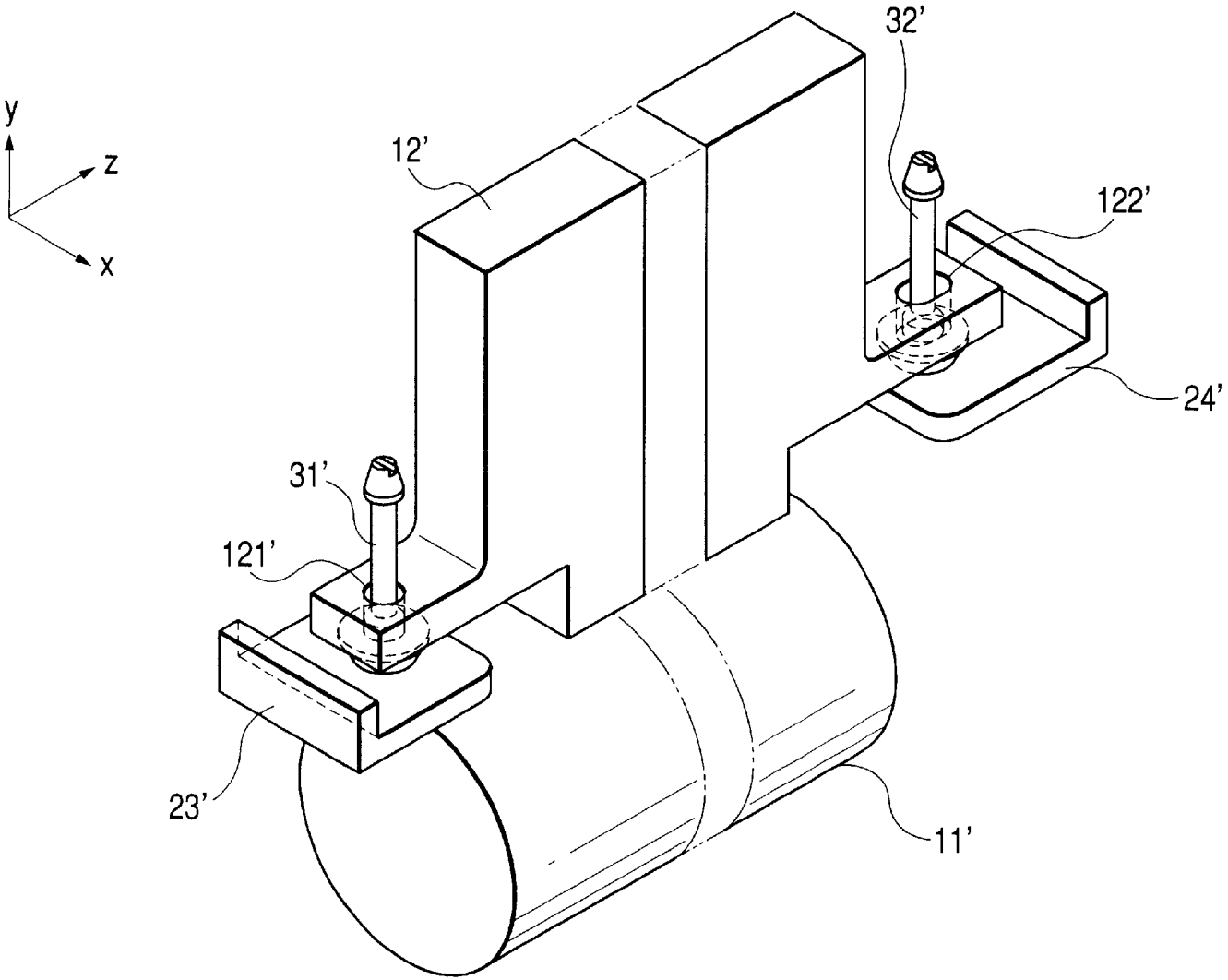
FIG. 10 is a perspective view descriptive of a conventional photosensitive drum and a conventional exposing unit.
Figure 11:
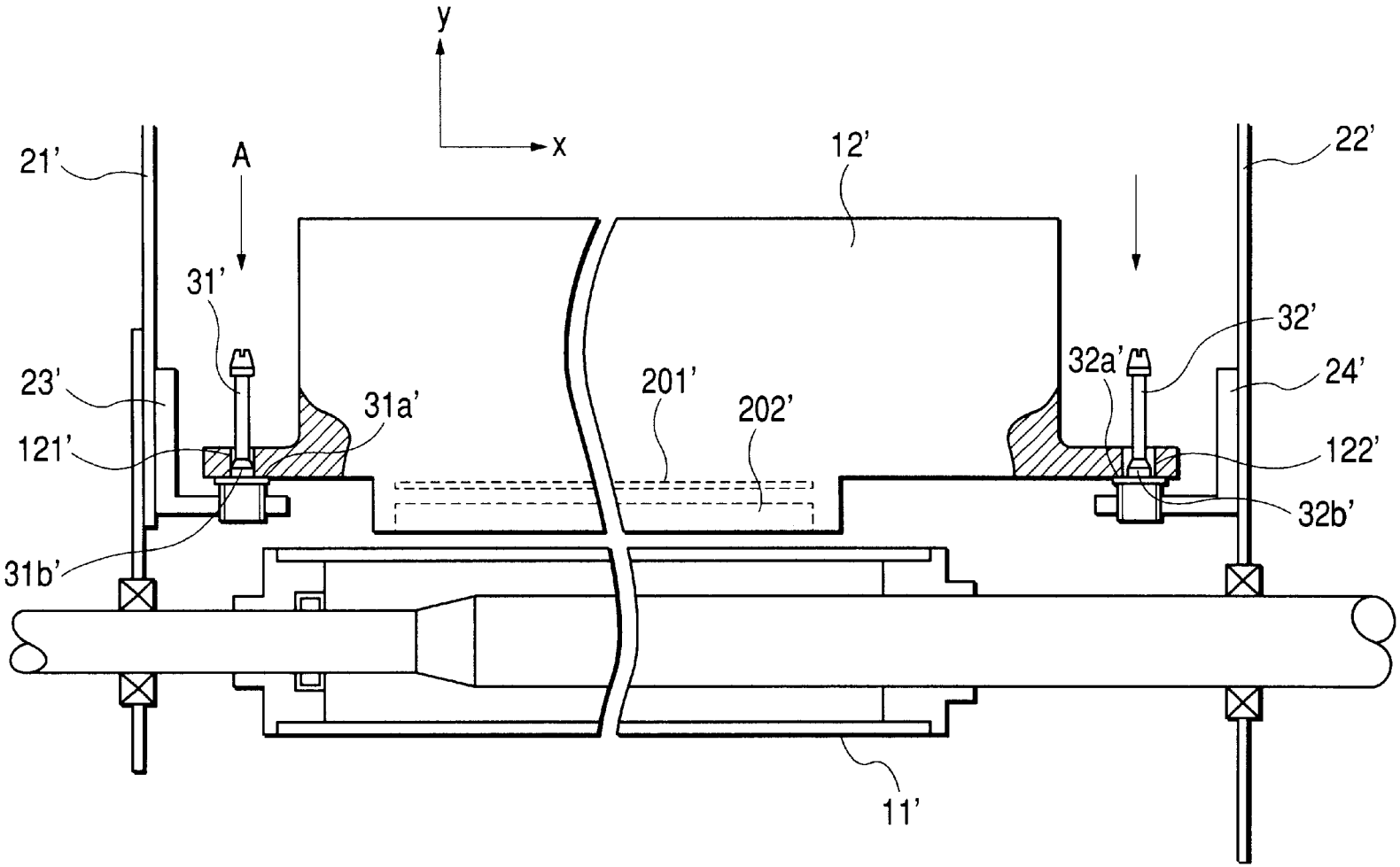
FIG. 11 is a side view descriptive of the photosensitive drum and the exposing unit shown in FIG. 10.
Figure 12B:
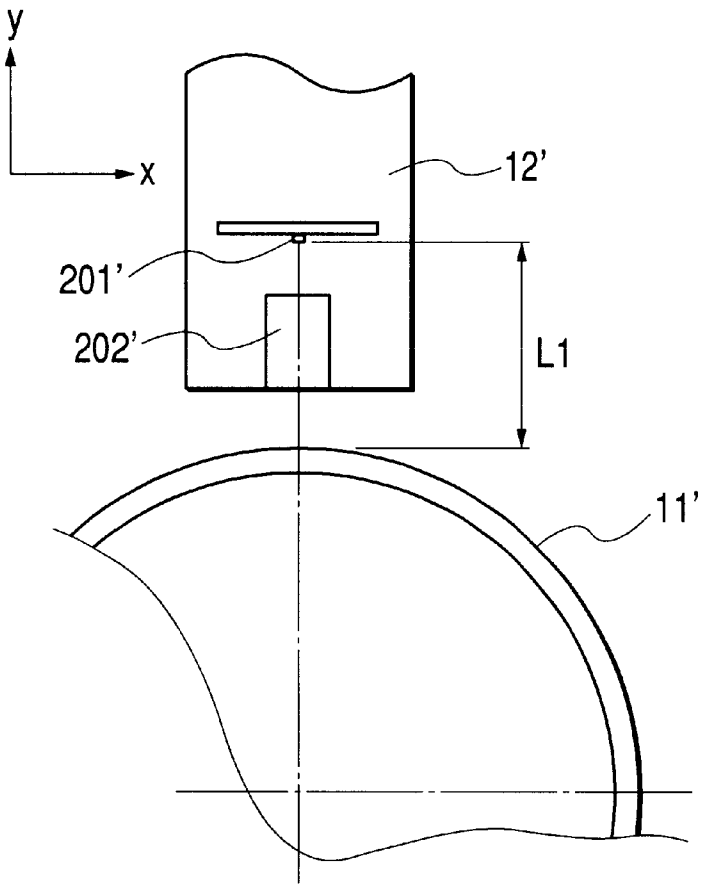
FIG. 12A is a sectional view of a focusing pin portion 31 of an exposing unit which is ideally positioned and FIG. 12B is an optical diagram showing a regular condition corresponding to FIG. 12A.
Figure 12A:
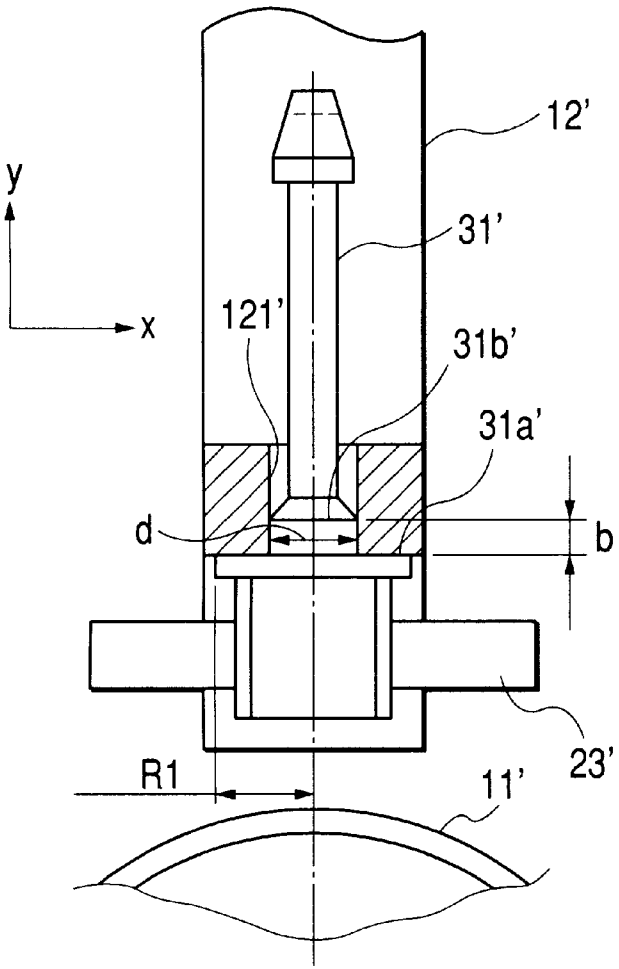
Figure 13B:
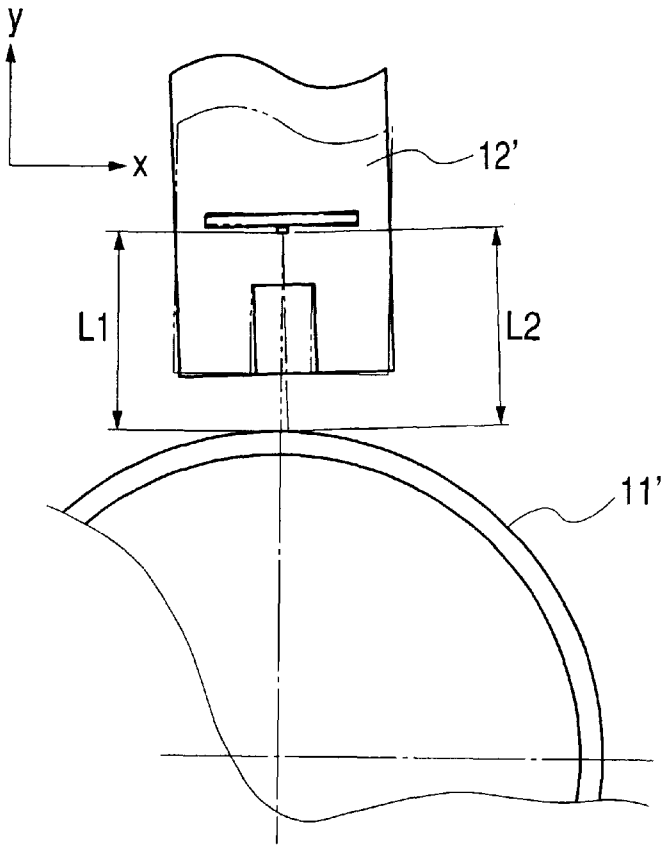
FIG. 13A is a diagram showing a condition where the exposing unit is inclined and FIG. 13B is an optical diagram of the inclined condition corresponding to FIG. 13A.
Figure 13A:
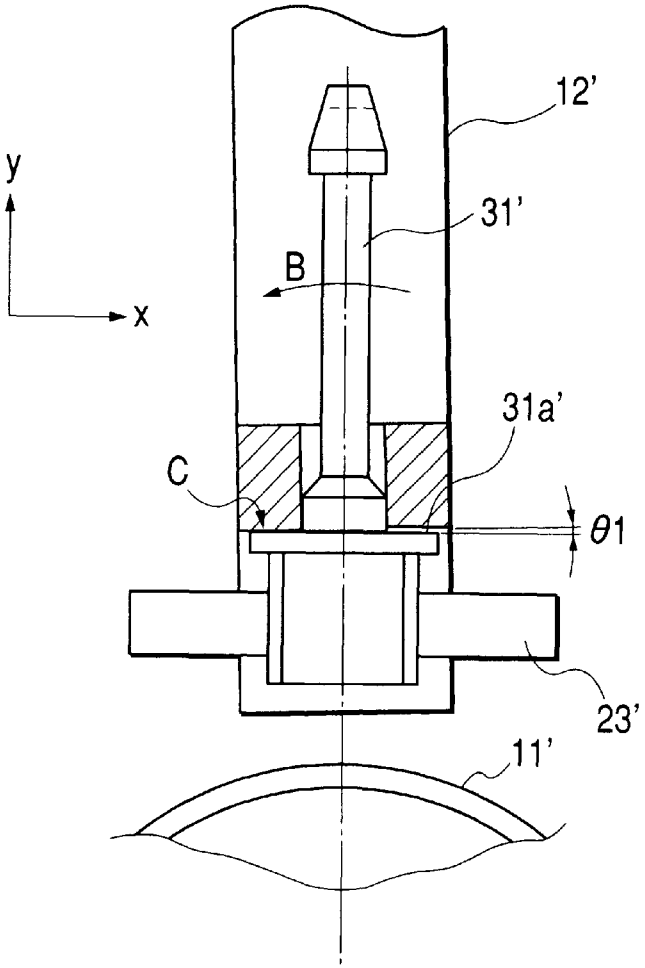
Figure 14:
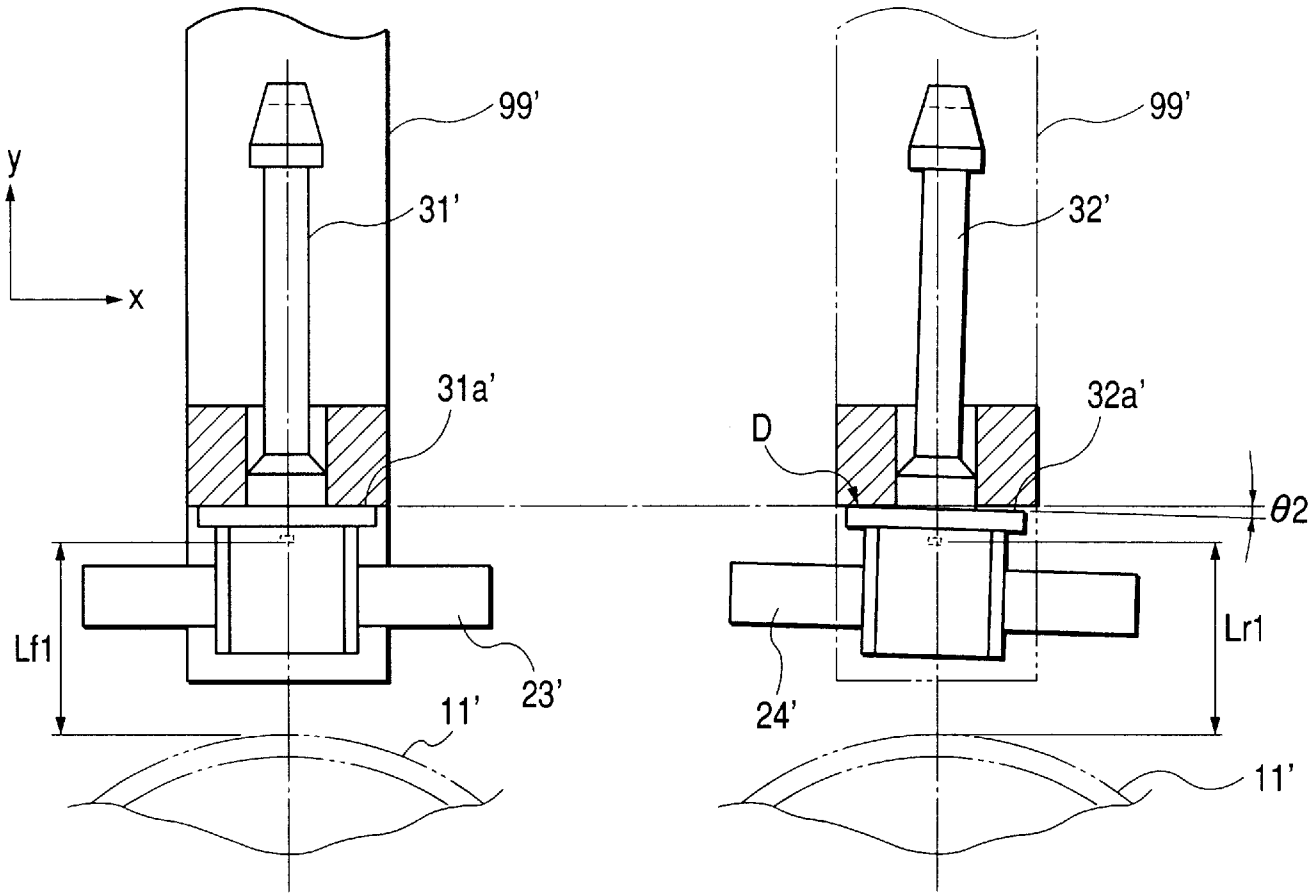
FIG. 14 is a diagram descriptive of a condition where jig units are mounted in a condition inclined relative to focusing pins at an exposing unit positioning time.
Figure 15:
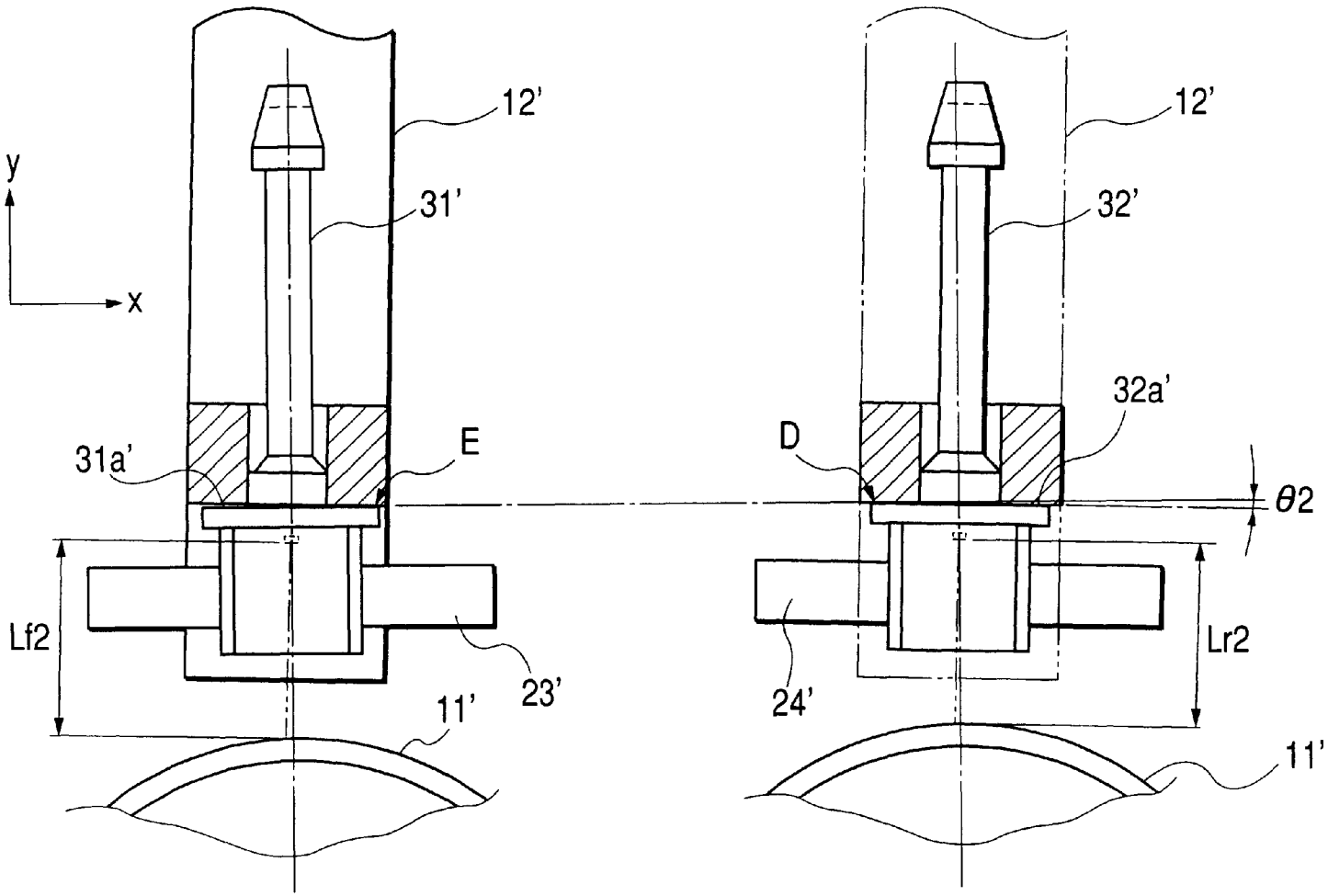
FIG. 15 is a diagram descriptive of a condition where an exposing unit does not reproduce a position determined with the jig units and is mounted in a condition inclined relative to the focusing pins.

Referring to FIGS. 7 through 9, description will be made of a third embodiment which has a configuration for positioning an oblong LED head 12 to be used as exposing means. FIG. 7 is a perspective view descriptive of the LED head 12 as a whole, FIG. 8 is a front view descriptive of positioning of the LED head and FIG. 9 is a plan view descriptive of the positioning of the LED head. In the third embodiment also, members which are the same as those in the above described embodiments are denoted by the same reference numerals.

The LED head 12 has a total of three fitting portions are formed for positioning the LED head. Formed in a front side of the LED head 12 is a round hole 121 which is fitted around a root portion 31*b* of a focusing pin 31. On a rear side, a root portion 32*b* of a focusing pin 32 is fitted in an elongated round hole 122.

An elongated round facing 126 is formed in a left side front surface of the LED head 12 in which an end 41*b* of a pin 41 is fitted. The pin 41 is a part which is to be fixed to a front side plate 21 of a main body. Shaft diameters d1, d2 and d5 of these members are 4 mm. Furthermore, fitting lengths b1, b2 and b5 are on the order of 1 to 2 mm.

For positioning the LED head 12 in a height direction, on the other hand, there is adopted a method similar to that in the first embodiment which adjusts heights of the focusing pins 31 and 32 relative to base members 23 and 24, and mounts the LED head 12 on two pedestals 31*a* and 32*a* of the focusing pins as in the first embodiment.

In the configuration of the third embodiment, a plane (x-z plane) is defined by three locations of surfaces of the pedestals 31*a*, 32*a* of the focusing pins and the fitting portion of the pin 41. Since the surfaces of the pedestals 31*a* and 32*a* are used not as surfaces but as points for positioning, no hindrance is caused even when the surfaces of the pedestals are inclined.

Similarly to the above described first and second embodiments, the third embodiment has a configuration which strictly determines a position of the LED unit in an angle direction around a z axis. As a result, the configuration of the third embodiment provides a function and an effect which are similar to those described as contents of the first and second embodiments.

In addition, the left side positioning portion is not limited to the front surface and may be on the left side (a surface H shown in FIG. 9) or a rear surface (a surface I). In such a case, the pin 41 is fixed to a stay (not shown) or a rear side plate 22 of the main body.

What is claimed is:

1. An exposing apparatus for exposing a photosensitive body, comprising:

an exposing unit provided opposite said photosensitive body for exposing said photosensitive body;

a plurality of first fixing members for positioning and fixing a vicinity of ends of said exposing unit on a side opposed to said photosensitive body; and a second fixing member for fixing a vicinity of an end of said exposing unit on a side opposite to fixing positions fixed by said plurality of first fixing members.

2. An exposing apparatus according to claim 1, wherein said plurality of first fixing members are disposed so as to permit adjusting a distance between said exposing unit and said photosensitive body.

3. An exposing apparatus according to claim 1, said exposing apparatus further comprising a pin member, wherein an end portion of said pin member functions as one of said plurality of first fixing members and another end portion of said pin member functions as said second fixing member.

4. An exposing apparatus according to claim 1, wherein one second fixing member is provided.

5. An exposing apparatus according to claim 1, wherein one of said plurality of first fixing members is long, another of said plurality of first fixing member is short, and the long one of said plurality of first fixing members serves also as said second fixing member.

6. An exposing apparatus according to claim 1, wherein said exposing apparatus is used in an electrophotographic type image forming apparatus.

7. An exposing apparatus according to claim 1, wherein said exposing apparatus uses a light emitting diode as an exposing light source.

* * * * *